US006203357B1

(12) United States Patent
Lovell et al.

(10) Patent No.: US 6,203,357 B1
(45) Date of Patent: Mar. 20, 2001

(54) APPARATUS AND METHOD FOR INSTALLING NON-BRIDGED TELECOMMUNICATION ACCESS LINES

(75) Inventors: John Winsor Lovell, Sherborn; Warner George Harrison, Medfield, both of MA (US)

(73) Assignee: Verizon Laboratories Inc., Waltham, MA (US)

( * ) Notice: Subject to any disclaimer, the term of this patent is extended or adjusted under 35 U.S.C. 154(b) by 0 days.

(21) Appl. No.: 09/383,058

(22) Filed: Aug. 25, 1999

(51) Int. Cl.[7] ..... H01R 4/24
(52) U.S. Cl. ..... 439/404
(58) Field of Search ..... 439/392, 404

(56) References Cited

U.S. PATENT DOCUMENTS 3,611,262 * 10/1971 Marley et al. ..... 339/97
4,326,767 * 4/1982 Silbernagel et al. ..... 339/98
5,961,340 * 10/1999 Littlejohn et al. ..... 439/392

* cited by examiner

*Primary Examiner*—Brian Sircus
*Assistant Examiner*—Thanh-Tam Le
(74) *Attorney, Agent, or Firm*—Leonard Charles Suchyta

(57) ABSTRACT

A connector for cutting and connecting an insulated cable having an insulation layer encasing at least one conductor that includes an upper member, and a lower member adapted for receiving the upper member including at least one insulation displacement connector to establish electrical connection with the conductor of the insulated cable, an instrument with a sharp edge to sever the conductor, and a rigid member to separate one end of the severed conductor from the other end of the severed conductor, wherein the upper member and the lower member secure both ends of the severed cable, to electrically connect a distribution cable to local terminals of access lines or subscriber lines and simultaneously cut the distribution cable to remove a bridged tap from the subscriber lines. The connector may additionally include a second blade and second plurality of insulation displacement connectors to allow the installation of terminal taps on both the Central Office side and field side, the connections of the latter being reserved for future use.

14 Claims, 2 Drawing Sheets

APPARATUS AND METHOD FOR INSTALLING NON-BRIDGED TELECOMMUNICATION ACCESS LINES

BACKGROUND OF THE INVENTION

1. Field of the Invention

This invention pertains in general to a telephone network and, more particularly, to an apparatus and method for installing non-bridged access lines.

2. Description of the Related Art

Multiconductor communications cables have been deployed by telephone companies for many years throughout the world, and a number of compression and insulation displacement "quick connect" techniques have been employed to connect single conductor, multiconductor, and bridged telephone lines. One common practice is to leave "in place" bridged tap connections at the end of a distribution cable having multi conductors at voice frequencies to allow the distribution cable to be used at multiple subscriber addresses. However, with the recent deployment of high bandwidth communications services such as Asymmetric Digital Subscriber Line (ADSL) and Very-High-Data-Rate Digital Subscriber Line (VDSL), bridged tap connections can adversely impact such high bandwidth communications services, and therefore must be removed at the time of installation of such services.

Thus, there is a need for an apparatus and method for simultaneous installation of high frequency bandwidth communications services from a distribution cable to a subscriber and removal of a bridged tap. There is also a need to allow for simultaneous installation of two sets of electrical connections while removing the section of the distribution cable therebetween to allow installation of filters for ADSL and VDSL services while permitting the use of jumpers to extend the distribution line for future use.

SUMMARY OF THE INVENTION

Accordingly, the present invention is directed to an apparatus and method for installing non-bridged telecommunication access lines that substantially obviates one or more of the problems due to limitations and disadvantages of the related art.

To achieve these and other advantages, and in accordance with the purpose of the invention as embodied and broadly described, there is provided a connector for cutting and connecting an insulated cable having an insulation layer encasing at least one conductor that includes an upper member and a lower member adapted for receiving the upper member including means for establishing electrical connection with the conductor by penetrating the insulation layer, and means for severing the conductor, wherein the upper member and the lower member secure the insulated cable.

In one aspect of the invention, the connector includes a means for moving a first end of the severed cable relative to a second end of the severed cable.

In another aspect of the invention, the means for severing is disposed between the means for establishing electrical connection and the means for moving.

In yet another aspect of the invention, the means for establishing electrical connection comprises a plurality of pins capable of penetrating the cable.

In still another aspect of the invention, the means for moving includes a rigid member for applying a reactive force against the first end of the severed cable when a force is applied against the upper member and the lower member to connect the upper and lower members.

Also in accordance with the invention, there is provided a connector for cutting and connecting an insulated cable having an insulation layer encasing at least one conductor that includes an upper member and a lower member adapted for receiving the upper member including at least one insulation displacement connector to establish electrical connection with the conductor of the insulated cable, an instrument with a sharp edge to sever the conductor, and a rigid member to separate one end of the severed conductor from the other end of the severed conductor, wherein the upper member and the lower member secure both ends of the severed cable.

Additionally in accordance with the invention, there is provided a connector for cutting and connecting an insulated cable having an insulation and multiple conductors that includes an upper member, and a lower member adapted for receiving the upper member including a first plurality of insulation displacement connectors to establish electrical connection with at least one of the multiple conductors of the cable, a first blade for severing the cable, a rigid member to separate one end of the severed cable away from the other end of the severed cable, a second blade for severing the cable, the rigid member being disposed between the first blade and the second blade, and a second plurality of insulation displacement connectors to establish electrical connection with at least one of the multiple conductors of the cable, wherein the first plurality of insulation displacement connectors are electrically isolated from the second plurality of insulation displacement connectors.

Also in accordance with the invention, there is provided a method of installing access lines to an insulated cable having an insulation layer encasing at least one conductor that includes splicing the cable to establish electrical connection with the conductor, severing the conductor, wherein the splicing and the severing steps are performed approximately simultaneously, and securing either end of the severed conductor, wherein the cable is secured during the splicing and the severing steps.

In accordance with one aspect of the invention, there includes a step of separating one end of the severed cable from the other end of the severed cable.

Additionally in accordance with the invention, there is provided a method of installing access lines to a multiconductor cable having a bridged tap connected to the cable that includes splicing the cable to establish a first electrical connection with first access lines, splicing the cable to establish a second electrical connection with second access lines, severing the cable wherein the established first electrical connection is electrically isolated from the bridged tap and the established second electrical connection is connected to the bridged tap, and wherein the both splicing steps and the severing step are performed approximately simultaneously, and securing either end of the severed cable, wherein the severed cable is secured during the splicing steps and the severing step.

Additional features and advantages of the invention will be set forth in the description which follows, and in part will be apparent from the description, or may be learned by practice of the invention. The objectives and other advantages of the invention will be realized and attained by the structures and methods particularly pointed out in the written description and claims thereof, as well as the appended drawings.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION

In accordance with the present invention, there are provided an apparatus and method for quick and efficient telecommunications installation of non-bridged terminals on a telephone distribution cable. The invention provides a connector that electrically connects the distribution cable to local terminals of access lines or subscriber lines and simultaneously cuts the distribution cable to remove the bridged tap from the subscriber lines. The present invention establishes electrical connection while simultaneously severing the distribution cable with respect to the bridged tap connection. The application of the invention includes single conductor wires, single telephone pairs, and multiple pairs.

Figure 1:
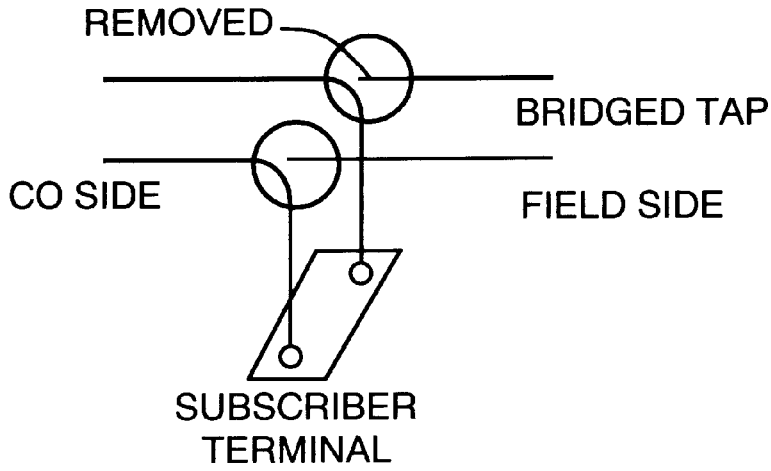
FIG. 1 shows a first embodiment of the invention wherein a telephone cable is connected to a single subscriber.
Figure 2:
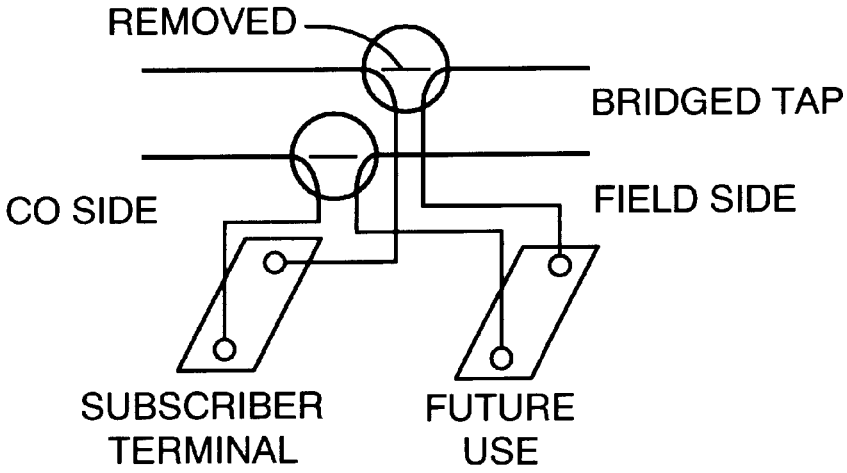
FIG. 2 shows a second embodiment of the invention wherein a telephone cable is connected to two terminals.

FIG. 1 shows a first embodiment of the invention wherein a telephone cable is connected to a single subscriber. Similarly, FIG. 2 shows a second embodiment of the invention wherein a telephone cable is connected to two terminals. In general, a telephone distribution cable consists of two conductors and is routed through a telephone network from the Central Office (CO), known as the "CO side," to a service subscriber, known as the "field side." When subscriber service is required at a location nearer to the CO side rather than the field side, a splice of the cable is made to route the telephone cable to the subscriber via a terminal as shown in FIG. 1. Simultaneous with the splicing of the cable, the cable is cut to the field side of the splice to disconnect the bridged tap at the field side.

Referring to FIG. 2, a second implementation of the present invention allows the installation of terminal taps on both the CO side and field side while simultaneously cutting the cable to remove the bridged tap. The connections made at the field side may be reserved for future use.

Figure 3A:
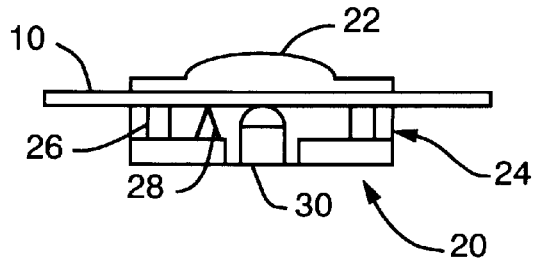
FIGS. 3A and 3B show an embodiment of the connector in accordance with the present invention in pre-installation and post-installation phases, respectively.
Figure 3B:
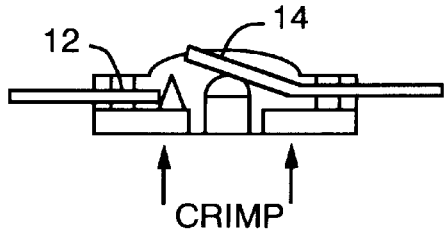

FIGS. 3A and 3B show one embodiment of a connector 20 in accordance with the present invention in pre-installation and post-installation phases, respectively. Referring to FIG. 3A, a portion of a multiconductor distribution cable 10 is positioned in connector 20. Connector 20 includes an upper member 22 and a lower member 24 adapted to receive upper member 22. In one embodiment, one end of upper member 22 is attached to one end of lower member 24 as, for example, in single conductor wire applications. In another embodiment, upper member 22 and lower member 24 are separate elements of connector 20. Such embodiment finds application in multiple pairs. Connector 20 may be connected to access lines (not shown) to establish connection with a subscriber's premises.

Lower member 24 includes a plurality of insulation displacement connectors 26, a blade 28, and a rigid member 30. Although only a single blade 28 and single rigid member 30 are shown, connector 20 may include a plurality of blades 28 and a plurality of rigid members 30. Insulation displacement connectors 26 are capable of penetrating the insulation of cable 10 to establish electrical connections with one or more of the multiple conductors (not shown) disposed inside cable 10 when an external force is applied. Connectors 26 may be metallic pins or equivalent structures that penetrate the insulation of cable 10 to establish electrical connection with the conductor(s) disposed within the insulation.

Blade 28 is capable of severing at least the conductors disposed within the insulation of cable 10, and may be implemented in connector 20 with any sharp instrument for severing the conductors disposed within the insulation of cable 10 when an external force is applied. In a preferred embodiment, blade 28 or the sharp instrument severs cable 10. In addition, blade 28 is segmented so that the conductors are not short circuited during severing, especially in multiple-pair applications. Rigid member 30 separates one end of the severed cable away from the other end of the severed cable. In one embodiment of the invention, blade 28 is disposed between insulation displacement connectors 26 and rigid member 30.

In operation and referring to FIG. 3B, when an external force is applied to connect upper member 22 with lower member 24 of connector 20, insulation displacement connectors 26 penetrate the insulation of cable 10 to establish electrical connection with one or more of the multiple conductors disposed inside cable 10. At the same time, blade 28 severs cable 10 thereby severing the electrical connection between insulation displacement connectors 26, which are electrically connected to access lines, and the bridged tap at the end of cable 10. As described above, so long as blade 28 is segmented, the conductors disposed inside cable 10 are not short circuited during the severing process. Simultaneously, rigid member 30 moves a first end 14 of the severed cable away from a second end 12 of the severed cable relative to first end 14. Specifically, rigid member 30 applies a reactive force against first end 14 of the severed cable as upper member 22 connects to lower member 24. The force that connects upper member 22 to lower member 24 may be a crimping force to crimp members 22 and 24. During the connection and severing processes, both ends of the severed cable are securely held by connector 20.

Figure 4A:
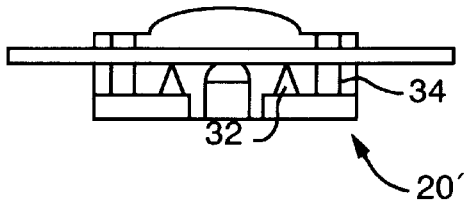
FIGS. 4A and 4B show another embodiment of the connector in accordance with the present invention in pre-installation and post-installation phases, respectively.
Figure 4B:
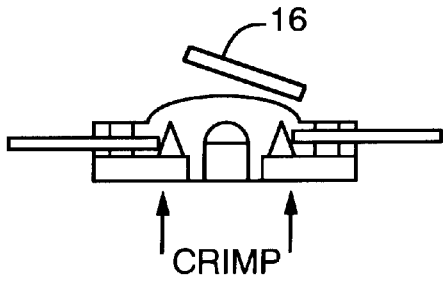

FIGS. 4A and 4B show another embodiment of a connector 20' in accordance with the present invention in pre-installation and post-installation phases, respectively. Referring to FIG. 4A, connector 20' additionally includes a second blade 32 and second plurality of insulation displacement connectors 34. Connector 20' allows the installation of terminal taps on both the CO side and field side and maintains all the properties and advantages described above and shown in FIGS. 3A and 3B. The connections established at the field side by second plurality of insulation displacement connectors 34 may be reserved for future use. Second blade 32 severs cable 10 similar to that of blade 28.

A method of installing access lines consistent with the present invention includes splicing cable 10 to establish at least one electrical connection with the multiple conductors in cable 10, and simultaneously severing cable 10. At the same time, the method secures the severed cable during the splicing and the severing steps and continues to secure the severed cable until such time when connector 20 releases severed cable 10. The method also moves one severed end of the cable from the other end. Specifically, when connector 20 or 20' is crimped, the resulting splicing of cable 10 is shown FIGS. 3B and 4B, respectively. After crimping, insulation displacement connectors 26 and 34 will have spliced through cable 10 with conventional insulation displacement. In addition, cable 10 is cut, severed and moved out of the way by rigid member 30. Specifically referring to FIG. 4B, rigid member 30 expels the scrap cable section 16 following the splicing and severing steps. In short, the method consistent with the present invention may be employed to simultaneously splice and sever single conductor, single pair, or multi-pair cables.

It will be apparent to those skilled in the art that various modifications and variations can be made in the disclosed process and product without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A connector for cutting and connecting an insulated cable having an insulation layer encasing at least one conductor, comprising:

an upper member; and a lower member adapted for receiving said upper member including first means for establishing electrical connection with the conductor by penetrating the insulation layer, second means for establishing electrical connection with the conductor by penetrating the insulation layer, means for severing the conductor, said means being disposed between said first means for establishing electrical connection and said second means for establishing electrical connection, and means for moving a first end of the severed cable relative to a second end of the severed cable, wherein said upper member and said lower member secure the insulated cable and said first means establishes electrical connection with said first end of the severed cable and secures said first end of the severed cable, and said second means establishes electrical connection with said second end of the severed cable and secures said second end of the severed cable.

2. The connector as claimed in claim 1, wherein said first means for establishing electrical connection comprises a plurality of pins capable of penetrating the cable.

3. The connector as claimed in claim 1, wherein said first means for establishing electrical connection establishes electrical contact with each of the multiple conductors of the cable.

4. The connector as claimed in claim 1, wherein said first means for severing comprises a blade.

5. The connector as claimed in claim 1, wherein said means for moving comprises a rigid member for applying a reactive force against said first end of said severed cable when a force is applied against said upper member and said lower member to connect said upper and lower members.

6. The connector as claimed in claim 1, wherein said means for severing severs the cable.

7. A connector for cutting and connecting an insulated cable having an insulation layer encasing at least one conductor, comprising:

an upper member; and a lower member adapted for receiving said upper member including means for establishing electrical connection with the conductor by penetrating the insulation layer;

means for severing the conductor, wherein said upper member and said lower member secure the insulated cable;

means for moving a first end of the severed cable relative to a second end of the severed cable; and a second means for severing, said means for moving being disposed between said second means for severing and said means for severing.

8. A connector for cutting and connecting an insulated cable having an insulation layer encasing at least one conductor, comprising:

an upper member; and a lower member adapted for receiving said upper member including a first insulation displacement connector to establish electrical connection with the conductor of the insulated cable;

a second insulation displacement connector to establish electrical connection with the conductor of the insulated cable;

an instrument with a sharp edge to sever the conductor; and a rigid member to separate a first end of the severed conductor from a second end of the severed conductor, wherein said upper member and said lower member secure both said first and second ends of said severed cable, and said first means establishes electrical connection with said first end of the severed cable and secures said first end of the severed cable, and said second means establishes electrical connection with said second end of the severed cable and secures said second end of the severed cable.

9. The connector as claimed in claim 8, wherein said instrument includes a blade disposed between said first and second insulation displacement connectors.

10. The connector as claimed in claim 8, additionally comprising a second blade, said rigid member being disposed between said instrument and said second blade.

11. The connector as claimed in claim 8, wherein said instrument severs the insulated cable.

12. A connector for cutting and connecting an insulated cable having an insulation and multiple conductors, comprising:

an upper member; and a lower member adapted for receiving said upper member including a first plurality of insulation displacement connectors to establish electrical connection with at least one of the multiple conductors of the cable;

a first blade for severing the cable;

a rigid member to separate one end of the severed cable from the other end of the severed cable;

a second blade for severing the cable, said rigid member being disposed between said first blade and said second blade; and a second plurality of insulation displacement connectors to establish electrical connection with at least one of the multiple conductors of the cable, wherein said first plurality of insulation displacement connectors are electrically isolated from said second plurality of insulation displacement connectors.

13. The connector as claimed in claim 12, wherein said each of first and second plurality of insulation displacement connectors establishes electrical contact with one of the multiple conductors of the cable.

14. The connector as claimed in claim 12, wherein said upper member and said lower member secure both ends of said severed cable.

* * * * *